United States Patent [19]

Enomoto et al.

[11] Patent Number: 4,887,436

[45] Date of Patent: Dec. 19, 1989

[54] DEFROSTING SYSTEM FOR A HEAT EXCHANGER

[75] Inventors: Toshihiko Enomoto; Yasuo Nakashima; Takashi Watanabe; Takao Komai; Tatsuya Mochizuki, all of Shizuoka, Japan

[73] Assignee: Mitsubishi Denki Kabushiki Kaisha, Tokyo, Japan

[21] Appl. No.: 265,514

[22] Filed: Nov. 1, 1988

[30] Foreign Application Priority Data

Nov. 18, 1987 [JP] Japan ..... 62-291398

[51] Int. Cl.[4] ..... F25D 21/06

[52] U.S. Cl. ..... 62/155; 62/156; 62/234

[58] Field of Search ..... 62/156, 155, 234, 151, 62/140

[56] References Cited

U.S. PATENT DOCUMENTS

| | | | |
|---|---|---|---|
| 4,209,994 | 7/1980 | Mueller et al. | 62/156 X |
| 4,251,988 | 2/1981 | Allard et al. | 62/234 X |
| 4,406,133 | 9/1983 | Saunders et al. | 62/155 X |
| 4,662,184 | 5/1987 | Pohl et al. | 62/156 |
| 4,751,825 | 6/1988 | Voorhis et al. | 62/234 |

FOREIGN PATENT DOCUMENTS

| | | |
|---|---|---|
| 62-46150 | 2/1962 | Japan . |
| 56-61530 | 5/1981 | Japan . |
| 58-16100 | 3/1983 | Japan . |

*Primary Examiner*—Harry B. Tanner

*Attorney, Agent, or Firm*—Oblon, Spivak, McClelland, Maier & Neustadt

[57] ABSTRACT

A defrosting system for a heat exchanger includes a temperature detector arranged adjacent to the exchanger, a temperature memory for storing temperature data detected by the detector, and a central processing unit, wherein when a second temperature which is detected by the temperature detector after normal operation requested by a user has restarted and after a predetermined minimum defrosting prohibitive time has passed, drops by a predetermined difference in temperature from a first temperature which is detected by the temperature detector after the normal operation has restarted and after a predetermined defrosting prohibitive time has passed, and the second temperature is a predetermined temperature or below; the central processing unit carries out the defrosting operation. As a result, when the amount of frost has rapidly increased during the defrosting prohibitive time, the defrosting operation is carried out even if the defrosting prohibitive time has not passed, thereby deteriorating the capability of the exchanger and preventing the frost from remaining after the defrosting operation has been completed.

1 Claim, 5 Drawing Sheets

DEFROSTING SYSTEM FOR A HEAT EXCHANGER

BACKGROUND OF THE INVENTION

1. Field of the Invention

The present invention relates to a defrosting system for a heat exchanger which is utilized in an air conditioner and so on, in particular to an improved control in defrosting operation for the heat exchanger.

2. Discussion of Background

In general, the heat exchanger is utilized in an air conditioner, a refrigerator, a refrigerated show case and so on.

The application of the heat exchanger will be described in reference to a conventional defrosting system in the air conditioner which is disclosed in Japanese Unexamined Pat. Publication No. 61530/1981.

FIG. 5 is a block diagram showing the conventional defrosting system. Reference numeral 1 designates an outdoor heat exchanger. Reference numeral 2 designates a temperature detector which is arranged in close proximity to the outdoor heat exchanger 1. Reference numeral 3 designates a defrosting start/end signal generating device. Reference numeral 4 designates a timer for controlling a prohibitive time against defrosting operation, which is connected to the defrosting start-/end signal generating device. Reference numeral 5 designates a timer for counting the time required to complete the defrosting operation. The timer 5 is connected to the generating device 3 and the timer 4, and counts the time for which the generating device 3 is outputting a defrosting operation signal.

In operation, when the air conditioner carries out heating operation, the outdoor heat exchanger 1 functions as an evaporator. The formation of frost on the heat exchanger causes the evaporation temperature to drop. The evaporation temperature is detected by the temperature detector 2. When the detected temperature drops to a predetermined temperature or below (i.e. a great amount of frost is formed on the heat exchanger, reducing its efficiency), a temperature signal is input from the temperature detectror 2 to the defrosting start-/end signal generating device 3. The timer 5 for counting the time required to complete the defrosting operation determines the time for which the restarted heating operation must be continued after the completion of the previous defrosting operation, and counts the time for which the heating operation is being carried out. When the counted time reaches the determined time, the timer 5 outputs a time up signal to the defrosting start/end signal generating device 3. The generating device 3 outputs a defrosting start signal when it has received the temperature signal and the time up signal.

The timer 4 is used to set the next prohibitive time against the defrosting operation depending on the time required to complete the last defrosting operation, which is counted by the timer 5. The timer 4 sets the next prohibitive time in such manner that when the time required to complete the last defrosting operation is short, the next prohibitive time is lengthened (because the formation of frost can be considered to be small), and when the time required to complete the last defrosting operation is long, the next prohibitive time is shortened (because much frost is likely to be formed on the heat exchanger). A defrosting end signal is output by the defrosting start/end signal generating device 3 when during the defrosting operation, the temperature detector 3 detects a temperature having a predetermined value or above (i.e. it detects a temperature not lower than the predetermined value that can not obtained when the frost remains).

Such structure of the conventional defrosting system creats problems wherein the defrosting system can be significantly affected by weather conditions to be prevented from carrying out its proper defrosting performance and the outdoor heat exchanger 1 can not restore the ability as the evaporator. Specifically, when humidity around the outdoor heat exchanger 1 becomes high during the heating operation wherein a longer prohibitive time is set, the amount of frost which has been formed on the heat exchanger until lapse of the prohibitive time can be greater than expected, thereby requiring to greatly lengthen the next defrosting time. At the worst, the defrosting operation fails to have fully defrosted the heat exchanger, and the frost which has not been eliminated can remains as ice.

It is an object of the present invention to eliminate the problems of the conventional defrosting system and to provide a defrosting system for a heat exchanger capable of keeping stable defrosting performance even if weather conditions such as humidity change, and of maintaining high efficiency of the heat exchanger.

The foregoing and the other objects of the present invention have been attained by providing a defrosting system for a heat exchanger comprising a temperature detector adapted to be arranged in close proximity to a heat exchanger; a temperature memory for storing temperature data detected by the temperature detector; a first timer for counting a defrosting prohibitive time; a second timer for counting the time required to complete the defrosting operation; a switching means for switching the flowing direction of a refrigerant to the heat exchanger; and a central processing unit for controlling the temperature memory, the first and second timers, and the switching means, and further carrying out arithmetic manipulations; wherein the central processing unit sets the next prohibitive time depending on the time counted by the second timer; and when a second temperature which is detected by the temperature detector after normal operation requested by a user has restarted and after a predetermined minimum defrosting prohibitive time has passed, drops by a predetermined difference in temperature from a first temperature which is detected by the temperature detector after the normal operation has restarted and after a predetermined time has passed, and when the second temperature is a predetermined temperature or below; the central processing unit carries out the defrosting operation even if the prohibitive time has not passed.

In accordance with the present invention, the next prohibitive time is set to be modified in accordance with the defrosting time. In addition, when the evaporation temperature of the heat exchanger drops by a predetermined value from the maximum value after normal operation (heating or cooling operation) starts, the defrosting operation is initiated. As a result, when the amount of frost on the heat exchanger is small and the defrosting operation ends in a short time, the interval between the last defrosting operation and the next one can be prolonged, allowing the heat exchanger to maintain effective capability. In addition, when the amount of frost on the heat exchanger has suddenly increased due to the change of air conditions and so on during a long porhibitive time against the defrosting operation, the defrosting operation is carried out even if the prohibitive time has not passed yet, preventing the capability of the heat exchanger from lowering and the frost from remaining after the defrosting operation. In this way, the present invention offers advantage of providing the defrosting system having high reliability and good efficiency.

BRIEF DESCRIPTION OF THE DRAWINGS

A more complete appreciation of the invention and many of the attendant advantages thereof will be readily obtained as the same becomes better understood by reference to the following detailed description when considered in/connection with the accompanying drawings, wherein.

DETAILED DESCRIPTION OF THE PREFERRED EMBODIMENTS

Figure 1:
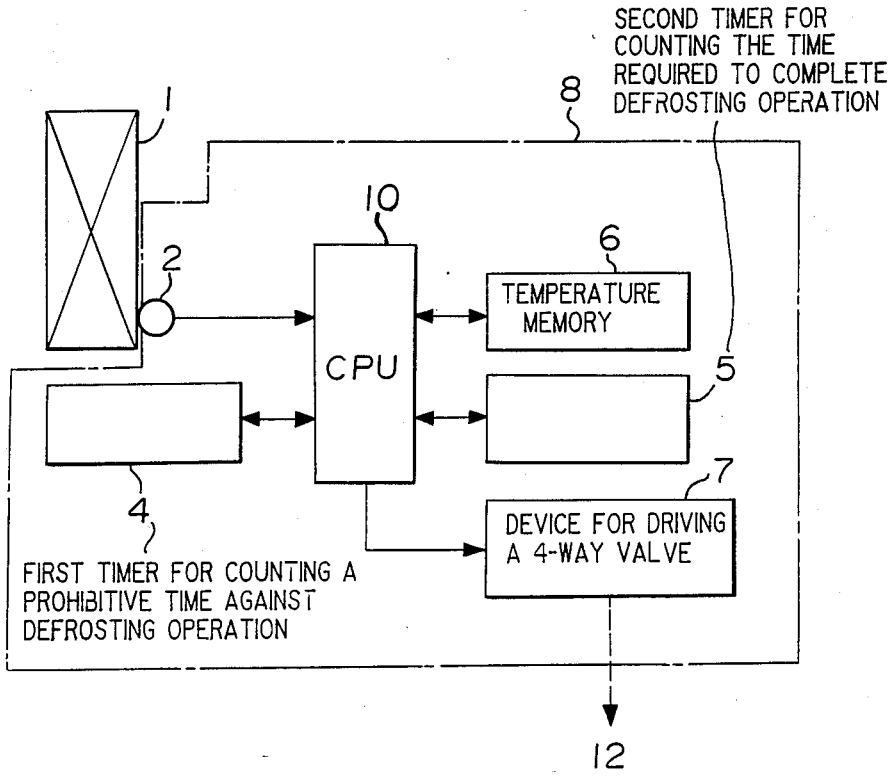
FIG. 1 is a block diagram showing an embodiment of the defrosting system according to the present invention.

Referring now to the drawings, wherein like reference numerals designate identical or corresponding parts throughout the several view, and more particularly to FIG. 1 thereof, there is shown a block diagram of an embodiment of the defrosting system according to the present invention. In FIG. 1, the defrosting system includes a temperature detector 2 arranged in close proximity to an outdoor heat exchanger 1, a first timer 4 for counting a prohibitive time against defrosting operation, a second timer 5 for counting the time required to complete the defrosting operation, a temperature memory 6 for storing temperature data detected by the temperature detector 2, a device 7 for driving a 4-way valve as switching means for switching the flowing direction of a refrigerant to the heat exchanger 1, and a central processing unit (hereinbelow, referred to as CPU) 10. The first timer 4 sets, counts and resets the prohibitive time against the defrosting operation depending on signals from the CPU 10. The second timer 5 counts the time between the start and the end of the defrosting operation depending on signals from the CPU 10. The device 7 for driving the 4-way valve acts depending on signals from the CPU 10. The CPU 10 carries out arithmetic manipulations on the temperature data detected by the temperature detector 2 in addition to controlling the operations of the temperature memory 6, the first and second timers 5 and 6, the device 7 for driving the 4-way valve, and so on. Reference numeral 8 designates the whole defrosting system having the structure as stated above.

Figure 2:
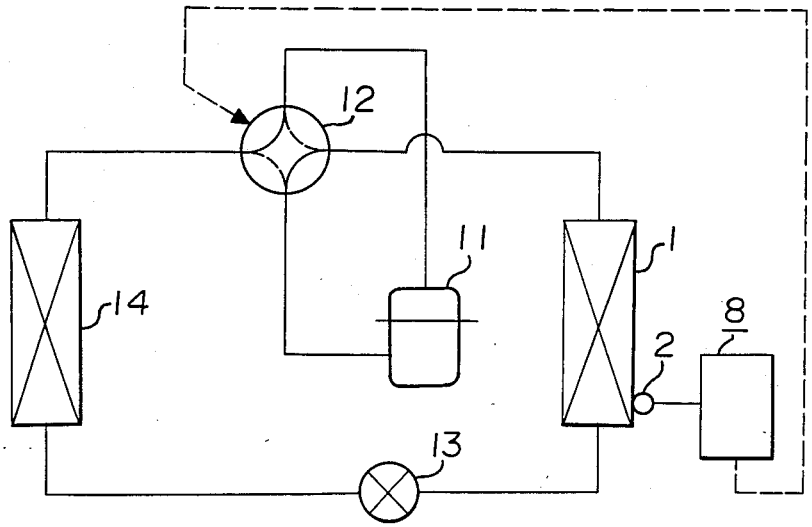
FIG. 2 is a refrigerant circuit diagram in an air conditioner with the system of the embodiment incorporated in it.

FIG. 2 is a block diagram showing a refrigerant circuit in an air conditioner with the defrosting system incorporated in it. Reference numeral 11 designates a compressor. Reference numeral 12 designates the 4-way valve which can be switched by the device 7. Reference numeral 13 designates a decompression device. Reference numeral 14 designates an indoor heat exchanger. These members are combined by refrigerant types to constitute the refrigerant circuit.

The operation of the embodiment will be explained with reference to heating operation and defrosting operation, referring to FIG. 2. At the time of heating operation, the 4-way valve 12 takes a switched position (hereinbelow, referred to as ON position) as indicated by solid lines. A gaseous refrigerant having a high temperature and a high pressure which has been compressed by the compressor 11 flows to the 4-way valve 12. While the refrigerant is passing through the indoor heat exchanger 14, the gas is condensed to dissipate heat, performing heat exchanging with the air in a room with the heat exchanger 14 installed in it.

Then, the refrigerant is depressurized by the decompression device 13 to become a two-phase refrigerant having a low pressure. The two-phase refrigerant comes into the outdoor heat exchanger 1 where it performs heat exchanging with the outdoor air to evaporate while passing therethrough. After that, the refrigerant returns to the compressor 11 through the 4-way valve 12. Such cycle is repeated.

If the outdoor air has a low temperature and high humidity, frost is formed on the outdoor heat exchanger, and the defrosting system 8 outputs a defrosting command to drive the 4-way valve 12 so as to place it in a switched position (hereinbelow, referred to as OFF position) as indicated dotted lines of FIG. 2. As a result, the flow of the refrigerant is switched in the direction opposite to that in the heating operation cycle, causing the outdoor heat exchanger 1 to act as a condenser and the indoor heat exchanger 14 to act an evaporator. This can defrost the outdoor heat exchanger 1. When the defrosting operation ends, the defrosting system 8 sends a defrosting end command to drive the 4-way valve 12 so as to return it to the ON position as indicated by the solid lines of FIG. 2. Thus, the heating operation cycle restarts.

The operation of the refrigerant cycle is as explained above. Now, the operations of the defrosting start command and the defrosting end command which are sent by the defrosting system 8 will be described in detail in reference to FIGS. 1, 3 and 4.

Figure 3:
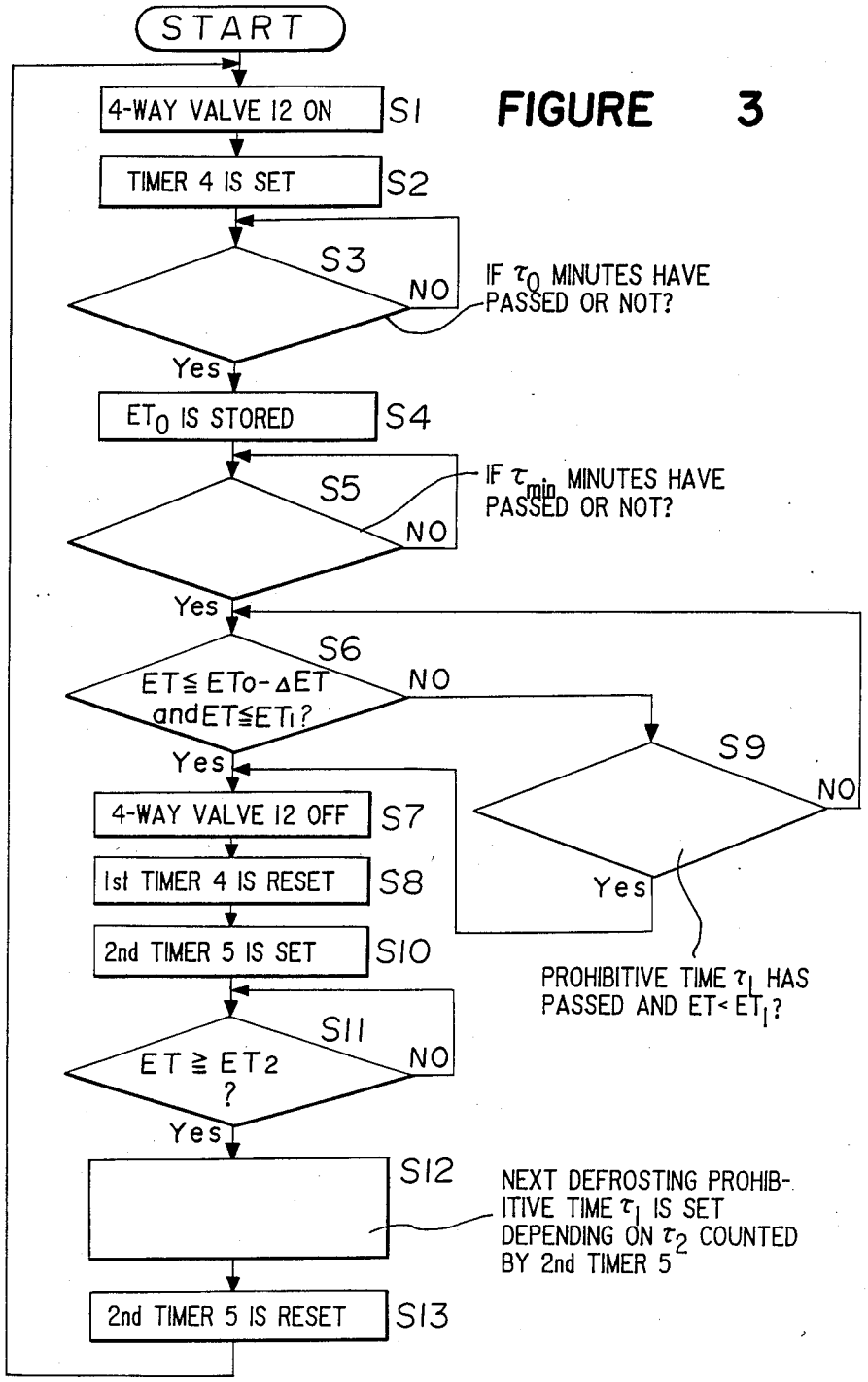
FIG. 3 is a flow chart showing the operation of the embodiment.

FIG. 3 is a sequence flow chart showing the operation of the embodiment. When the heating operation starts, the CPU 10 sends an ON signal to the device 7 to place the 4-way valve 12 in the ON position at a step S1. At a step S2, the CPU 10 sets the first timer 4 for counting a prohibitive time against the defrosting operation to cause the timer 4 to start counting. At a step S3, it is judged if a predetermine time $\tau_0$ minutes have passed or not. If positive (Yes), the CPU 10 catches the evaporation temperature ET detected by the temperature detector 2, and cause the temperature memory 6 to store it as the first detected temperature $ET_0$ at a step S4.

The time "$\tau_0$" is defined as a time when the evaporation temperature almost reaches the maximum value after starting the heating operation, and which is found on experiment in advance and is initialized at the time of the production.

At a step S5, it is judged if a predetermined minimum prohibitive time $\tau_{min}$ minutes against the defrosting operation have passed or not. If affirmative (Yes), the CPU 10 performs operation on the following equation:

$$a = ET_0 - \Delta ET \quad (1)$$

The time "$\tau_{min}$" is defined as a minimum value which requires for continuing the air-conditioning operation (heat or cooling operations) as requested by a user for such period that if the defrosting operation is restarted, a user does not feel unpleasantly for the defrosting operation. This value can be found on experiment in advance to be temporarily set at the time of production. The set value can be adjusted depending on the volume of a space to be air-conditioned, information on the temperature around the heat exchanger with frost formed on it, and other information, at the time of starting the air-conditioning operation or in the course of the air-conditioning operation.

The "ΔET" is defined as a predetermined lowering width of the evaporation temperature. The lowering width is determined, on experiment in advance, so that if the evaporation temperature drops by the lowering width, a great amount of frost has been formed on the heat exchanger, and it is necessary to perform the defrosting operation for the period ($\tau_{min}-\tau_0$) from the predetermined time $\tau_0$ to the minimum prohibitive time $\tau_{min}$.

At a step S6, an evaporation temperature ET as the second detected temperature detected by the temperature detector 2 at that time is compared as follows:

$$\left.\begin{array}{l} ET \leqq a \\ \text{and } ET \leqq ET_1 \end{array}\right\} \quad (2)$$

If the equations are satisfied (Yes), the CPU 10 judges that the defrosting operation must start, outputs an OFF signal to the 4-way valve driving device 7 to place the 4-way valve 12 in the OFF position (a step S7). The CPU 10 also resets the first timer 4 (a step S8) and starts the defrosting operation.

The term "$ET_1$" is a perdetermined evaporation temperature that is considered to be unable to reach when frost is not formed on the heat exchanger, and that is considered to create significant deterioration in the heat exchanger capability. The predetermined evaporation temperature $ET_1$ is obtained based on the results of experiment and so on in advance, and is set at the time of the production. On the other hand, if at least one of the judgment conditions (2) is not satisfied (No) when it is judged at the step S5 that the minimum prohibitivie time $\tau_{min}$ minutes have passed the processing proceeds to a step S9. At the step S9, it is judged if a defrosting prohibitive time $\tau_1$ (as defined later on) which is counted by the first timer 4 has passed. At the step S9, it is also judged if the evaporation temperature ET which is detected as the second detection temperature by the temperature detector 2 has become a predetermined lower evaporation temperature $ET_1$ or not, i.e. if the following equation is satisfied or not:

$$ET \leqq ET_1 \quad (3)$$

If these judgment conditions are satisfied (Yes), the CPU 10 judges that the defrosting operation must start, and the processing proceeds to the step S7 where the CPU 10 outputs the OFF signal to the 4-way valve driving device 7 to place the 4-way valve 12 in the OFF position. Then, the CPU 10 resets the first timer 4 and starts the defrosting operation at the step S8.

In summary, the defrosting starting conditions are as follows:

$$\left.\begin{array}{l} \tau_{min} \text{ minutes or more have passed} \\ \text{and } ET \leqq ET_0 - \Delta ET \\ \text{and } ET \leqq ET_1 \end{array}\right\} \quad (4)$$

or $$\left.\begin{array}{l} \tau_1 \text{ minutes or more have passed} \\ \text{and } ET \leqq ET_1 \end{array}\right\} \quad (5)$$

The defrosting operation starts when the judgment conditions (4) or (5) are satisfied.

The defrosting prohibitive time $\tau_1$ is a period for which the next defrosting operation should be prevented, i.e. the air-conditioning operation such as the heating operation as requested by a user should be continued, and which is calculated based on the time required to complete the previous defrosting operation. The defrosting prohibitive time $\tau_1$ is determined such that a conditioned environment wherein the user is neither required for patience nor feels uncomfortly can be maintained in the room during the next defrosting operation. The defrosting prohibitive time $\tau_1$ for each defrosting operation is set based on the previous defrosting operation time, in accordance with standardized references which are obtained on experiment in advance and so on.

When the defrosting operation starts, the CPU 10 sets a second timer 5 for counting the time required to complete the defrosting operation, so as to count the time required for complete the defrosting operation at a step S10. At the next step S11, the CPU 10 judges if the evaporation temperature ET detected by the temperature detector 2 has been increased to a predetermined temperature $ET_2$ (as defined later on) or not. If affirmative (Yes), the CPU judges to be able to end the defrosting operation. At a step S12, the CPU sets the next defrosting prohibitive time $\tau_1$ depending on the time counted by the timer 5 by that time, i.e. the time $\tau_2$ required to complete the defrosting operation. At a step S13, the CPU resets the second timer 5, outputs the ON signal to the 4-way valve driving device 7 to place the 4-way valve 12 in the ON position, and restarts the heating operation.

The relationship between the time $\tau_2$ required to complete the defrosting operation and the defrosting prohibitive time $\tau_1$ is determined such that if the time $\tau_2$ is short (which means that the amount of frost on the heat exchanger is small), the next defrosting prohibitive time $\tau_1$ is prolonged, and if the time $\tau_2$ is long (which means that the amount of the frost is great), the next defrosting prohibitive time $\tau_1$ is shortened.

The predetermined evaporation temperature $ET_2$ is defined as the one at which it can be judged that the frost can not exist. This value is set at the time of the production. The very limit which is obtained the results of the experiment can be used as the predetermined temperature $ET_2$. If value greater than presumed value is taken as the predetermined evaporation temperature $ET_2$, the temperature $ET_2$ can be set without performing the experiment.

Figure 4:
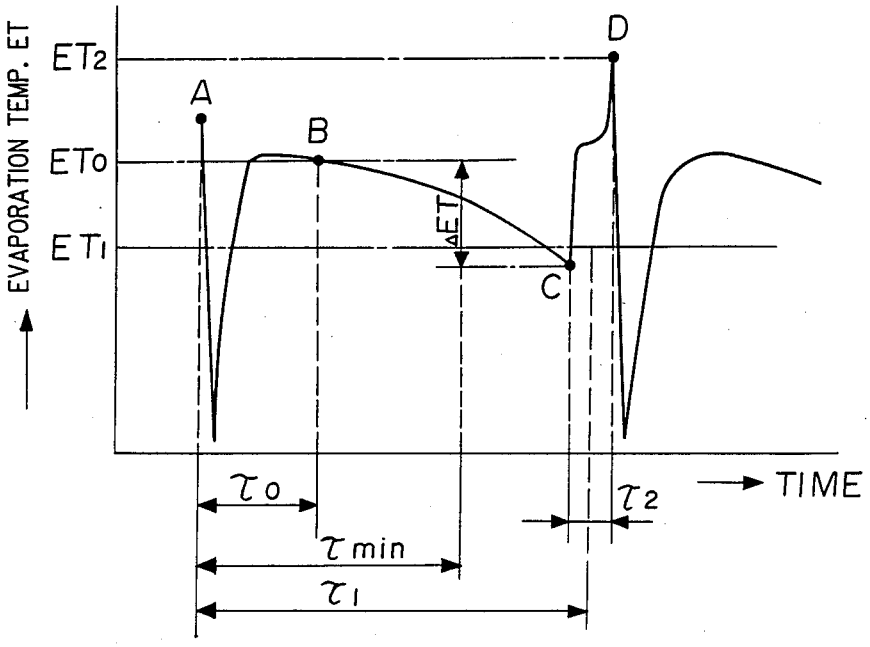
FIG. 4 is graphical representations showing the change in evaporation temperature with lapse of time during heating operation and during defrosting operation.
Figure 5:
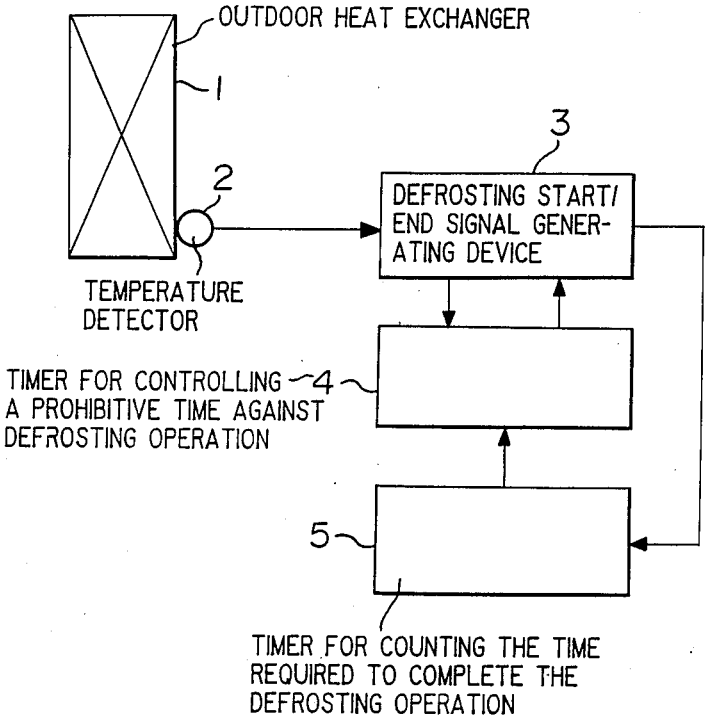
FIG. 5 is a block diagram showing one example of the conventional defrosting system.

FIG. 4 is graphical representations showing the change in the evaporation temperature ET detected by the temperature detector 2 at the time of the heating operation and the defrosting operation, wherein the horizontal axis indicates the time t and the longitudinal axis indicates the evaporation temperature ET. The operation of the defrosting system according to the present invention will be described in reference to FIG. 4, supplementing the explanation on the flow chart shown in FIG. 3.

A point A is the time of starting the heating operation, and the 4-way valve 12 lies in the ON position at that time. The evaporation temperature ET rapidly drops once, and then it rises again. After $\tau_0$ minutes have passed, the evaporation temperature ET reaches a point B which is closest to the maximum value of the evaporation temperature. The period $\tau_0$ is about ten minutes. The evaporation temperature ET at that time is stored as the first detected temperature $ET_0$ in the temperature memory 6.

The period $\tau_0$ slightly deviates from the maximum value on the actual curve as shown in FIG. 4 because the period $\tau_0$ is a preset value as mentioned earlier and the first controlling cycle by the defrosting system is carried out. However, the first detected temperature $ET_0$ which is stored in the temperature memory 6 is closest to the actual maximum value at that time, which can be seen from FIG. 4.

During the period after the point B (which is closest to the point which the evaporation temperature becomes the maximum), the change in the evaporation temperature ET is different depending on the amount of the frost. If the amount of the frost is great, the fall of the evaporation temperature is big. On the other hand, if the amount of the frost is small, the fall in the evaporation temperature ET is small or the evaporation temperature maintains constant. FIG. 4 shows a case wherein a relatively great amount of the frost is formed.

First, the heating operation is continued and the defrosting operation is not carried out during the period $\tau$min minutes, regardless of the amount of the frost. The defrosting operation starts at a point C (defrosting starting point) wherein after $\tau_{min}$ has passed, the second detection temperature ET is lowered by the accumulated frost to a temperature which is lower than the temperature $ET_0$ stored in the temperature memory 6 by not less than $\Delta ET$ which is the predetermined lowering width in temperature, and the evaporation temperature ET at that time becomes lower than the predetermined evaporation temperature $ET_1$. That is to say, FIG. 4 shows that the judgment conditions (4) are satisfied at the point C. This means that the defrosting operation starts before the defrosting prohibitive time $\tau_1$ has passed, i.e. at the time when the presence of the defrosting prohibitive time $\tau_1$ prevents the defrosting operation from being carried out in the conventional defrosting system.

Because there is no defrosting operation immediately prior to the heating operation wherein the first controlling cycle is carried out, a standardized time which is preset can be adopted as the defrosting prohibitive time $\tau_1$ in FIG. 4. The defrosting prohibitive time $\tau_1$ can be also set based on the data as memorized at the previous air-conditioning operation.

If the amount of the frost is small, the equation $ET \leqq ET_0 - \Delta ET$ in the judgment conditions (4) is not satisfied because the drop in the evaporation temperature ET is small (which is not shown in FIG. 4). The defrosting operation does not start until the defrosting prohibitive time $\tau_1$ minutes ($\tau_1 \geqq \tau_{min}$) or more have passed and the evaporation temperature ET has dropped to $ET_1$.

One example of the results of experiment shows that the 20 optimum values are follows:

$$ET_1 = -5 - -8^\circ \text{ C.},$$

$$\Delta ET = 8\text{-}10(^\circ \text{ C.}),$$

$$\tau_{min} = 30\text{–}40 \text{ minutes}$$

These values may change depending on the capability and performance of the air conditioning apparatus to be controlled by the defrosting system according to the present invention.

In the example as shown in FIG. 4, the 4-way valve 12 becomes OFF at the point C since the defrosting operation starts at that point. While the defrosting is progressing, the evaporation temperature ET is rising. When the evaporation temperature has raised to the predetermined temperature $ET_2$ and reached a point D (defrosting ending point), the defrosting operation ends. The time $\tau_2$ required to complete the defrosting operation is counted by the second timer 5. The next defrosting prohibitive time $\tau_1$ is freshly set based on the time $\tau_2$. For example, the relationship between the time $\tau_1$ and the time $\tau_2$ can be set stepwise as follows:

If $\tau_2 \leqq 3$, then $\tau_1 = 100$

If $3 < \tau_2 \leqq 6$, then $\tau_1 = 70$

If $6 < \tau_2$, then $\tau_1 = 30$

In the embodiment as explained, the next defrosting operation prohibitive time is changed depending on the last defrosting operation time. In addition, when the second detection temperature which is detected after lapse of the predetermined minimum defrosting prohibitive time has dropped by the predetermined value from the first detection temperature which is closest to the maximum value after the starting of the heating operation, the defrosting operation starts. As a result, if the amount of the frost is small and the defrosting operation is completed in a short time, the period between the last defrosting operation and the next defrosting operation can be prolonged, allowing the heating capability to be maintained at a high level. On the other hand, if the amount of the frost has rapidly increased due to the change in aerial conditions and so on during a defrosting operation prohibitive time which has been set to be prolonged, defrosting is carried out even if the defrosting operation prohibitive time has not passed, thereby preventing the heating capability from lowering and frost from remaining after the termination of the defrosting operation. It is advantageous to obtain a reliable and effective defrosting system.

By the way, the embodiment has been explained in reference to the case wherein the defrosting system according to the present invention is used to defrost the outdoor exchanger at the time of carrying out the heating operation in the air conditioner. The defrosting system can be also utilized to defrost the indoor heat exchanger at the time of carrying out cooling operation in the air conditioner. In addition, even if the defrosting system is used to defrost the evaporator for the freezing component of a refrigerator or for a refrigerating or freezing show case, the defrosting system can carry out defrosting effectively.

Obviously, numerous modifications and variations of the present invention are possible in light of the above teachings. It is therefore to be understood that within the scope of the appended claims, the invention may be practiced otherwise than as specifically described herein.

What is claimed is:

1. A defrosting system for a heat exchanger comprising:

a temperature detector adapted to be arranged in close proximity to a heat exchanger;

a temperature memory for storing temperature data detected by the temperature detector;

a first timer for counting a defrosting prohibitive time;

a second timer for counting the time required to complete the defrosting operation;

a switching means for switching the flowing direction of a refrigerant to the heat exchanger; and a central processing unit for controlling the temperature memory, the first and second timers, and the switching means, and further carrying out arithmetic manipulations;

wherein the central processing unit sets the next prohibitive time depending on the time counted by the second timer; and when a second temperature which is detected by the temperature detector after normal operation requested by a user has restarted and after a predetermined minimum defrosting prohibitive time has passed, drops by a predetermined difference in temperature from a first temperature which is detected by the temperature detector after the normal operation has restarted and after a predetermined time has passed, and when the second temperature is a predetermined temperature or below; the central processing unit carries out the defrosting operation even if the prohibitive time has not passed.

* * * * *